US008651307B2

(12) United States Patent
Deemer et al.

(10) Patent No.: US 8,651,307 B2
(45) **Date of Patent: *Feb. 18, 2014**

(54) HOT-FILL CONTAINER

(75) Inventors: David A. Deemer, Adrian, MI (US); Susan Deemer, legal representative, Adrian, MI (US); Carlos E. Londoño, Ann Arbor, MI (US)

(73) Assignee: Amcor Limited, Hawthorn (AU)

( * ) Notice: Subject to any disclaimer, the term of this patent is extended or adjusted under 35 U.S.C. 154(b) by 325 days.

This patent is subject to a terminal disclaimer.

(21) Appl. No.: 12/707,350

(22) Filed: Feb. 17, 2010

(65) Prior Publication Data

US 2010/0206837 A1 Aug. 19, 2010

Related U.S. Application Data

(60) Provisional application No. 61/153,475, filed on Feb. 18, 2009.

(51) Int. Cl.
*B65D 90/02* (2006.01)

(52) U.S. Cl.
USPC ..... 215/381; 215/379; 215/384; 215/375; 220/669; 220/670; 220/675

(58) Field of Classification Search
USPC ..... 215/379, 381, 384; 220/669, 670, 675
See application file for complete search history.

(56) References Cited

U.S. PATENT DOCUMENTS

| | | | | |
|---|---|---|---|---|
| 5,472,105 | A * | 12/1995 | Krishnakumar et al. | 215/384 |
| 6,164,474 | A | 12/2000 | Cheng et al. | |
| 6,779,673 | B2 * | 8/2004 | Melrose et al. | 215/381 |
| 7,472,798 | B2 * | 1/2009 | Stowitts | 215/381 |
| 2003/0015491 | A1 * | 1/2003 | Melrose et al. | 215/381 |
| 2004/0164047 | A1 | 8/2004 | White | |
| 2005/0121408 | A1 * | 6/2005 | Deemer et al. | 215/381 |
| 2008/0179271 | A1 | 7/2008 | Bangi | |

FOREIGN PATENT DOCUMENTS

| | | |
|---|---|---|
| JP | 2002-370721 | 12/2002 |
| JP | 2007-290762 | 11/2007 |

* cited by examiner

*Primary Examiner* — Anthony Stashick
*Assistant Examiner* — Cynthia Collado
(74) *Attorney, Agent, or Firm* — Harness, Dickey & Pierce, P.L.C.

(57) ABSTRACT

A one-piece plastic hot-fill container may employ a shoulder portion, a base portion and a sidewall portion, which may be integrally formed with and extend from the shoulder portion to the base portion. The container may further employ a plurality of compression ribs molded into the sidewall portion—a first of the plurality of compression ribs intersecting a second of the plurality of compression ribs to form a rib interface, at least the first and the second of the plurality of compression ribs changing from a first shape to a second shape in response to cooling of the liquid.

12 Claims, 5 Drawing Sheets

HOT-FILL CONTAINER

CROSS-REFERENCE TO RELATED APPLICATIONS

This application claims the benefit of U.S. Provisional Application No. 61/153,475, filed on Feb. 18, 2009. The entire disclosure of the above application is incorporated herein by reference.

FIELD

The present disclosure relates to a hot-fill, heat-set container with vacuum absorbing ribs on a contoured body of the container.

BACKGROUND

This section provides background information related to the present disclosure which is not necessarily prior art.

Hot-fill plastic containers, such as those manufactured from polyethylene terephthalate ("PET"), have been commonplace for the packaging of liquid products, such as fruit juices and sports drinks, which must be filled into a container while the liquid is hot to provide for adequate and proper sterilization. Because these plastic containers are normally filled with a hot liquid, the product that occupies the container is commonly referred to as a "hot-fill product" or "hot-fill liquid" and the container is commonly referred to as a "hot-fill container."

During filling of the container, the product is typically dispensed into the container at a temperature of at least 160° F., and more particular at about 180° F. Immediately after filling, the container is sealed or capped, such as with a threaded cap, and as the product cools to room temperature, such as 72° F., a negative internal pressure or vacuum develops within the sealed container. Although PET containers that are hot-filled have been in use for quite some time, such containers are not without their limitations.

One limitation of PET hot-fill containers is that because such containers receive a hot-filled product and are immediately capped, the container walls contract as vacuum forces increase during hot-fill product cooling. Because of this product contraction, hot-fill containers may be equipped with vertical columns and circumferential grooves. The vertical columns and circumferential grooves, which are normally parallel to the container's bottom resting surface, provide strength to the container to withstand container distortion and aid the container in maintaining much of its as-molded shape, despite the internal vacuum forces. Additionally, hot-fill containers may be equipped with vacuum panels to control the inward contraction of the container walls. The vacuum panels are typically located in specific wall areas immediately beside the vertical columns, and immediately beside and between the circumferential grooves so that the grooves and columns may provide support to the moving, collapsing vacuum panels yet maintain much of the overall shape of the container. Because of the necessity of the traditional vacuum panels in the container wall and support grooves above and below the vacuum panels to assist in maintaining the overall container shape, incorporating contour hand grips and other contours in the container wall, while preserving the ability of the container wall to absorb internal vacuum, is limited.

Therefore, there is a need in the relevant art to provide a hot-fill container with a wall that is capable of moving to absorb internal vacuum forces in response to cooling of an internal hot-fill liquid and capable of maintaining the overall shape of the container while providing a contoured hand grip area.

SUMMARY

This section provides a general summary of the disclosure, and is not a comprehensive disclosure of its full scope or all of its features.

According to the principles of the present teachings, a one-piece plastic hot-fill container is provided having a shoulder portion, a base portion and a sidewall portion, which may be integrally formed with and extend from the shoulder portion to the base portion. The container may further have a plurality of compression ribs molded into the sidewall portion—a first of the plurality of compression ribs intersecting a second of the plurality of compression ribs to form a rib interface, at least the first and the second of the plurality of compression ribs changing from a first shape to a second shape in response to cooling of the liquid.

Further areas of applicability will become apparent from the description provided herein. The description and specific examples in this summary are intended for purposes of illustration only and are not intended to limit the scope of the present disclosure.

DRAWINGS

The drawings described herein are to scale and are for illustrative purposes only of selected embodiments and not all possible implementations, and are not intended to limit the scope of the present disclosure. Corresponding reference numerals indicate corresponding parts throughout the several views of the drawings.

Figures 5A, 5B, 5C, 5D, 5E, 5F, 5G:
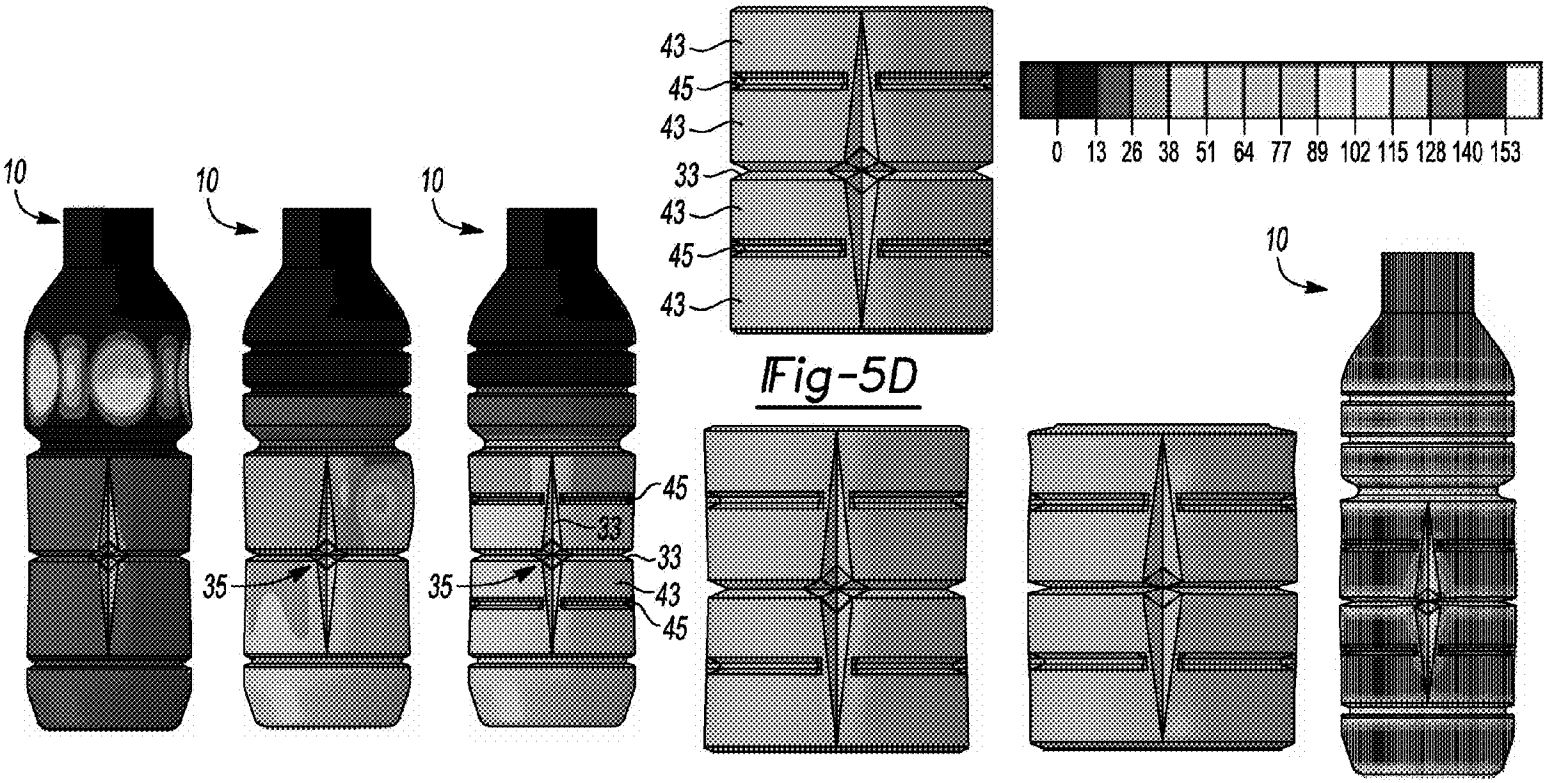
FIG. 5A is a view of the container containing vacuum absorbing ribs according to the teachings of the present disclosure in a capped and cooled condition without panel reinforcement ribs wherein compression rib collapse is not maximized.
FIG. 5B is a view of the container containing vacuum absorbing ribs according to the teachings of the present disclosure and some panel reinforcement in a capped and cooled condition illustrating controlled collapse of compression ribs.
FIG. 5C is a view of the container containing vacuum absorbing ribs according to the teachings of the present disclosure and panel reinforcement in a capped and cooled condition illustrating controlled and improved collapse of compression ribs.
FIG. 5D is an enlarged view of the container containing vacuum absorbing ribs according to the teachings of the present disclosure in an undeformed condition according to some embodiments of the present teachings.
FIG. 5E is an enlarged view of the container containing vacuum absorbing ribs according to the teachings of the present disclosure in a capped and cooled condition according to some embodiments of the present teachings.

FIG. 5F is an enlarged view of the container containing vacuum absorbing ribs according to the teachings of the present disclosure in a capped, cooled, and top-loaded condition according to some embodiments of the present teachings; and FIG. 5G is an enlarged view of the container containing vacuum absorbing ribs according to the teachings of the present disclosure in a filled, capped, and top loaded condition according to some embodiments of the present teachings.

DETAILED DESCRIPTION

The following description is merely exemplary in nature and is not intended to limit the present disclosure, application, or uses. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Turning now to FIGS. 1-5, details of a preferred embodiment of the present disclosure will be discussed. Turning first to FIGS. 1-2, a one-piece plastic, e.g. polyethylene terephthalate (PET), container 10 is depicted with a longitudinal axis L and is substantially cylindrical.

As depicted in FIGS. 1-2, the one-piece plastic container 10 defines a container body 12 and includes an upper portion 14 having a finish 16 and a neck 18. The finish 16 may have at least one thread (not shown) integrally formed thereon. A shoulder portion 22 extends downward from the finish 16. The shoulder portion 22 merges into and provides a transition between the finish 16 and a sidewall portion 24. The sidewall portion 24 extends downward from the shoulder portion 22 to a base portion 26 having a base 28, which may employ a contact ring. In some embodiments, the sidewall portion 24 may define a series of generally-horizontal contoured lands 30 and generally-horizontal contoured ribs 32, such as contour land 30 and contour rib 32. The contoured lands and contoured ribs, although traversing around the periphery of the container 10 as depicted in FIG. 1, may be arranged vertically from the shoulder portion 22.

The neck 18 may have an extremely short height—that is, becoming a short extension from the finish 16, or may have an elongated height, extending between the finish 16 and the shoulder portion 22. A circular support ring 34 may be defined around the neck 18. A threaded region 36 with its at least one thread may be formed on an annular sidewall above the support ring 34. The threaded region 36 provides a means for attachment of a similarly threaded closure or cap 27. The cap may define at least one thread formed around an inner diameter for cooperatively riding along the thread(s) of the finish 16. Alternatives may include other suitable devices that engage the finish 16 of the plastic container 10. Accordingly, the closure or cap engages the finish 16 to preferably provide a hermetical seal of the plastic container 10. The closure or cap is preferably of a material conventional to the closure industry and suitable for subsequent thermal processing, including high temperature pasteurization and retort. The shoulder portion 22 may define a transition area from the neck 18 and upper portion 14 to a panel area 40. The panel area 40 therefore, may be defined between the shoulder portion 22 and the base portion 26, and located on the sidewall portion 24. It should be appreciated that other label panel areas, both in terms of size and shape, are anticipated.

The container 10 may or may not include a number of the contour ribs, such as generally-horizontal contour rib 32. For instance, the container 10 may contain one or more contour ribs; however, the actual number of contour ribs may depend upon the actual physical size of the container 10 with containers larger than that depicted in FIGS. 1-2 likely to have more contour ribs and those smaller than that depicted in FIGS. 1-2 likely to have fewer contour ribs.

Figures 1A, 1B, 1C, 1D:
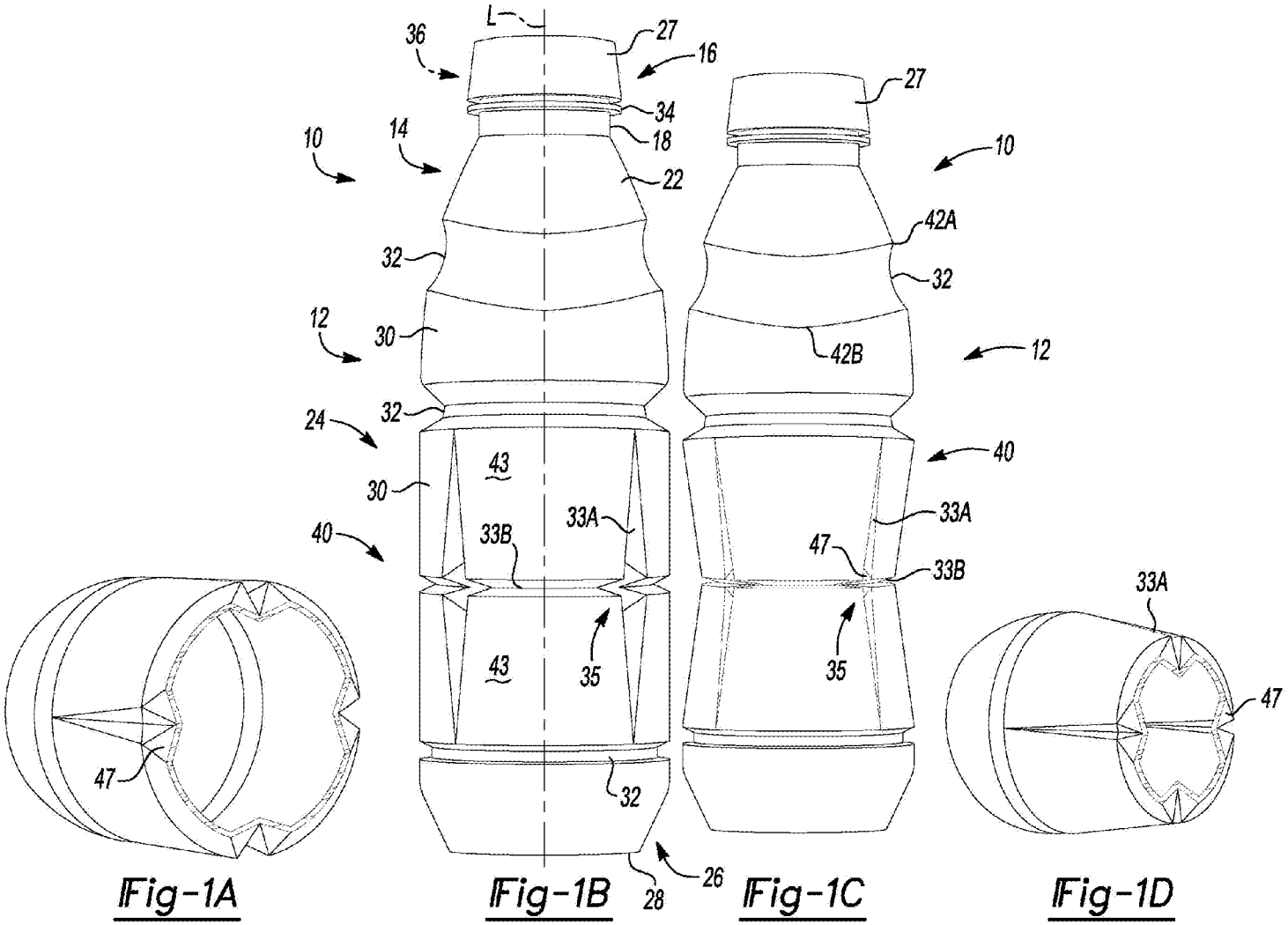
FIG. 1A is a partial cross-sectional view of a container containing vacuum absorbing ribs according to the teachings of the present invention in an undeformed condition.
FIG. 1B is a view of the container containing vacuum absorbing ribs according to the teachings of the present invention in an as-molded condition.
FIG. 1C is a view of the container containing vacuum absorbing ribs according to the teachings of the present invention in a capped and cooled condition.
FIG. 1D is a partial cross-sectional view of a container containing vacuum absorbing ribs according to the teachings of the present disclosure in a capped and cooled condition.
Figures 2A, 2B, 2C, 2D:
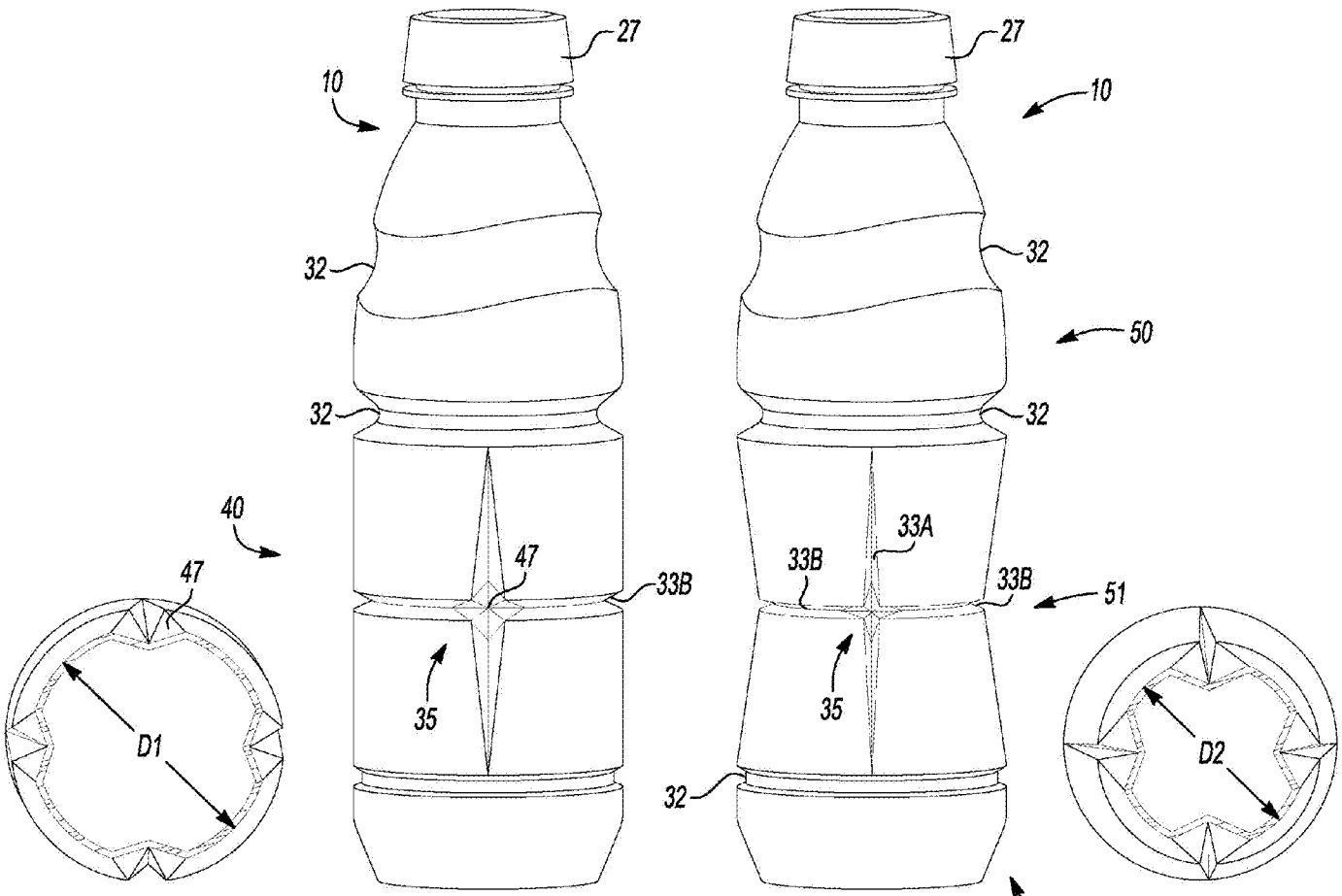
FIG. 2A is a partial cross-sectional view of a container containing vacuum absorbing ribs according to the teachings of the present disclosure in an as-molded condition.
FIG. 2B is a view of the container containing vacuum absorbing ribs according to the teachings of the present disclosure in an as-molded condition.
FIG. 2C is a view of the container containing vacuum absorbing ribs according to the teachings of the present disclosure in a capped and cooled condition.
FIG. 2D is a partial cross-sectional view of a container containing vacuum absorbing ribs according to the teachings of the present disclosure in a capped and cooled condition.

With reference to FIGS. 1-2, the contour ribs 32 may not be parallel to the support ring 34 or the base 28. However, in some embodiments, the contour ribs 32 may be arcuate in one or more directions about the periphery of the body 12 and the sidewall portion 24 of the container 10. More specifically, as depicted in FIGS. 1B, 1C, 2B, and 2C, the contour ribs 32 may be arced such that a center 42 of the contour ribs 32 is arced upward toward the neck 18, as in 42A, or arced downward toward the base 28 as in 42B. Such may be the case for all of the contour ribs 32 in the container 10 when viewed from the same side of the container 10. In rotating the container 10 and following the contour ribs 32 for 360 degrees around the container 10, the contour ribs 32 may have two (2) equally high, highest points, and two (2) equally low, lowest points.

With continued reference to FIGS. 1-5, container 10 may include a number of multi-directional compression ribs 33 and compression lands 43 disposed therebetween that form an intersecting cross or bi-directional hinge assembly 35. In some embodiments, intersecting hinge assembly 35 can comprise compression ribs 33, such as vertical compression ribs 33A and horizontal compression ribs 33B (collectively, compression ribs 33), intersecting at a rib interface 47. At the outset, it should be appreciated that intersecting hinge assembly 35 does not have to be configured to include vertical and horizontal ribs specifically. That is, intersecting hinge assembly 35 can comprise ribs that intersect each other at angles other than 90° and/or that extend along paths that are not aligned with or orthogonal to the central vertical axis L (see FIG. 1B). Moreover, intersecting hinge assembly 35 can comprise compression ribs that sweep an arcuate path. In this way, compression ribs 33 can form any one of a number of functional and aesthetically pleasing orientations. However, for purposes of simplicity of discussion and by way of non-limiting example, compression ribs 33A and 33B will be discussed in terms of vertical and horizontal components, respectively.

In some embodiments, intersecting hinge assembly 35 can provide any one of a number of advantages. Specifically, intersecting hinge assembly 35 can permit two-directional compression in response to vacuum forces. This compression can simultaneously close both the vertical compression ribs 33A and the horizontal compression ribs 33B. This simultaneous closure due to internal vacuum permits intersecting hinge assembly 35 to collapse in both directions (vertical and horizontal, in the present discussion), thereby resulting in a stronger container. This increased strength can result from structural economies, such as increased hoop strength, increased geometric strength from partially closed ribs defining narrower internal angles, and the like. Moreover, with proper configuration of the overall container through management of wall thickness, reinforcement ribs, and other features, compression in response to vacuum can be localized in compression ribs 33 without unduly effecting unintended areas or overall shape of container 10.

With particular reference to FIGS. 1-4, as mentioned, intersecting hinge assembly 35 can comprise a plurality of vertical compression ribs 33A and at least one horizontal compression rib 33B intersecting at rib interface 47. Collectively, the compression ribs 33 may each have an first wall 102 and a second wall 104 (see FIGS. 3-4) separated by an inner curved or angled wall 106, which is in part defined by a relatively sharp or small innermost radius. The relatively sharp innermost radius of inner wall 106 facilitates improved material flow during blow molding of the plastic container 10 thus enabling the formation of relatively large contour ribs. The relatively large portion of compression ribs 33 are generally better able to absorb internal vacuum forces and, in some cases, forces due to top loading than more shallow ribs, because a longer first wall 102 and a longer second wall 104 provide more of a cantilever to pivot at the inner wall 106.

Figure 3B:
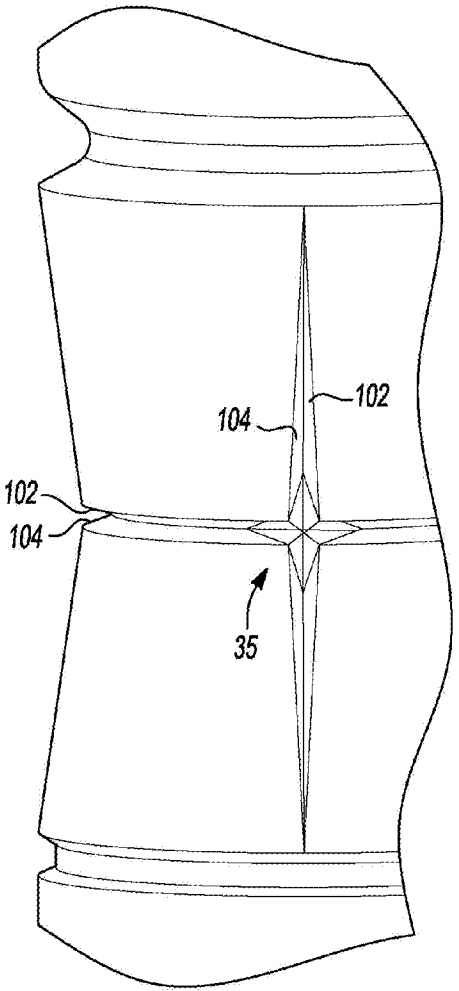
FIGS. 3A and 3B are enlarged front views of the container in an as-molded condition and in a capped and cooled condition, respectively.
Figure 3A:
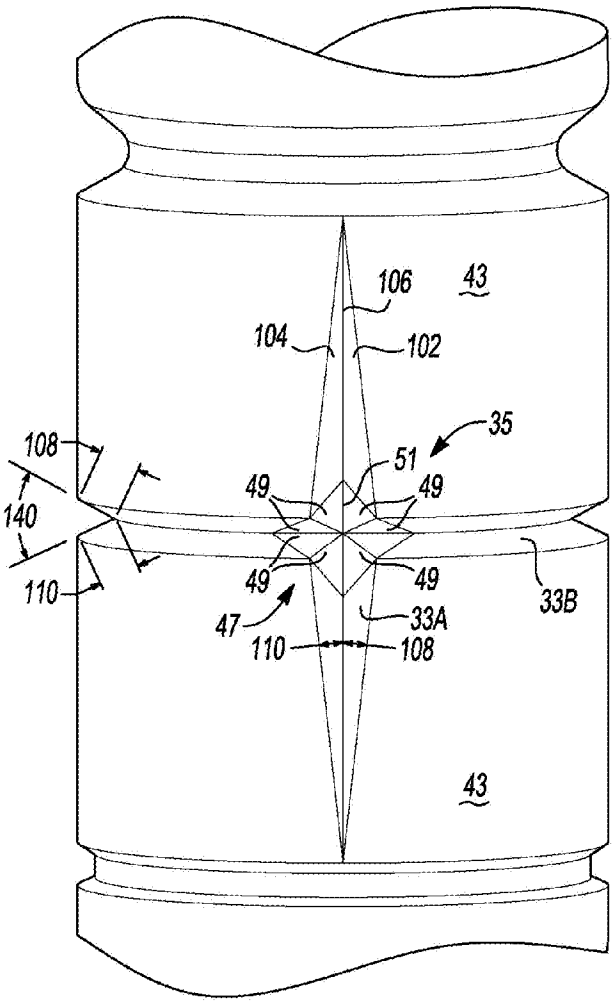

Continuing with FIG. 3A, first wall 102 can define a length 108 and second wall 104 can define a length 110. In some embodiments, length 108 and length 110 are identical. In some embodiments, length 108 and length 110 are identical to each other at a given position (i.e. horizontal compression rib 33B in FIG. 3A), but each vary along the length of a single compression rib 33 (i.e. vertical compression rib 33A in FIG. 3A). In some embodiments, length 108 and length 110 are different for a given position.

As illustrated in FIGS. 3A-3B, compression ribs 33 have a radii, walls, depth and width, which in combination form a rib angle or shape 140 that may, in an unfilled plastic container 10, define an initial angle or shape (see FIG. 3A). After hot-filling, capping and cooling of the container contents, the resultant vacuum forces may cause the rib angle or shape 140 to reduce to a capped angle or shape that is less than the initial angle or shape as a result of vacuum forces present within the plastic container 10 (see FIG. 3B). However, in some embodiments, compression ribs 33 are designed so that although the rib angle 140 may be further reduced to absorb vacuum forces, the first wall 102 and second wall 104 may never come into contact with each other as a result of vacuum forces. However, in other embodiments, the compression ribs can be configured so that they close completely and contact each other to create an overall stronger container.

Figure 4B:
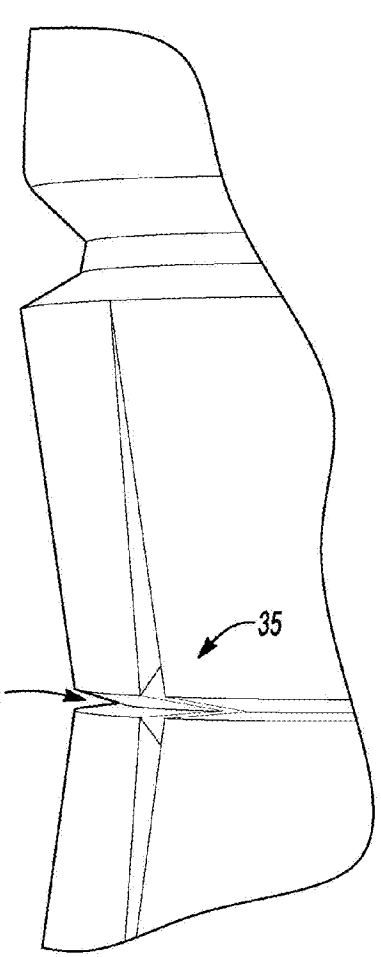
FIGS. 4A and 4B are enlarged front views of the container in an as-molded condition and in a capped and cooled condition, respectively.
Figure 4A:
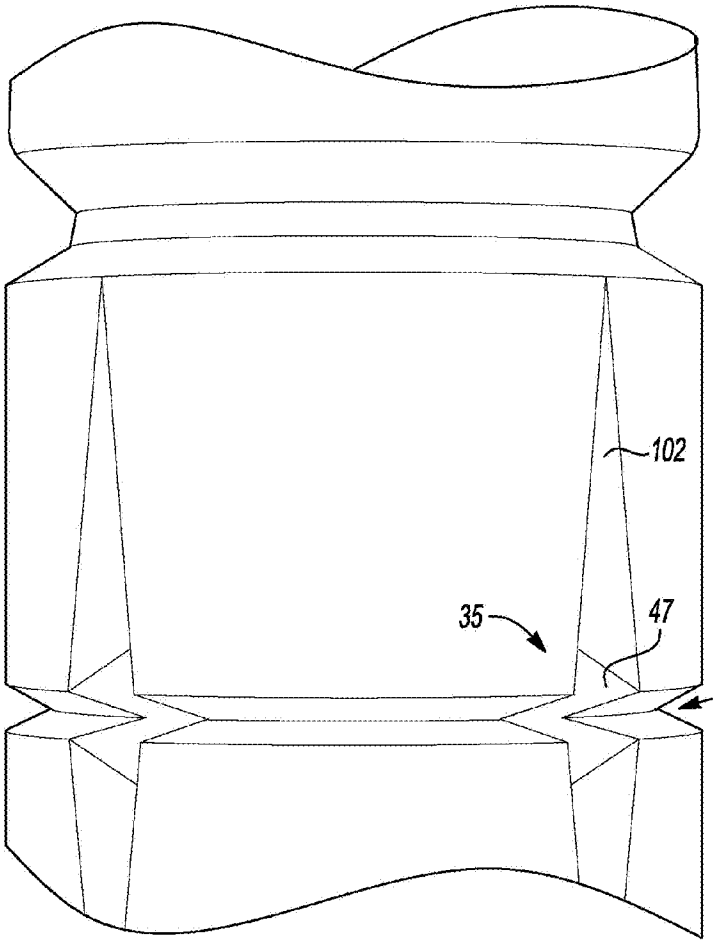

With particular reference to FIGS. 3 and 4, in some embodiments, rib interface 47 can comprise a plurality of interlocking surfaces generally defining an inwardly-directed, multi-faceted pyramidal shape. It should be appreciated that in embodiments where compression ribs 33 are outwardly-directed, rib interface 47 can similarly be outwardly directed. In the present embodiment, rib interface 47 comprises a pair of surfaces 49 generally rotated about 45° relative to the associated walls 102, 104 of the compression rib 33. Each pair of these surfaces 49 is formed to include a curved or angled wall 51 extending therebetween that permits relative hinging of surfaces 49. In this way, upon application of a vacuum force, compression ribs 33 can contract causing surfaces 49 and walls 51 of rib interface 47 to similarly contract.

It should be appreciated that, because of the unique operating relationship of compression ribs 33A and 33B with rib interface 47, compression ribs 33A and 33B can contract more than they would if they were continuous ribs. In other words, as seen in FIGS. 2A and 2D, an initial internal diameter of compression rib 33B can be defined as D1. However, upon application of vacuum force, compression of container 10 causes collapse of compression rib 33B. The amount of this compression would conventionally be limited to the internal diameter of a conventional continuous rib. However, in the present disclosure, rib interface 47 and compression rib 33A together permit compression rib 33B to collapse to a final internal diameter D2. Final internal diameter D2 is less than initial internal diameter D1. A similar relationship exists in connection with vertical compression rib 33A.

As discussed, the compression ribs 33, because of their protrusion, extend inwardly within (toward the interior) or outwardly from (away from the interior) the container 10 and are able to collapse upon themselves to a certain degree when the vacuum within the container 10 reaches a predetermined or prescribed pressure. The pressure at which the compression ribs 33 will collapse upon themselves is dependent not only upon the vacuum forces within the container 10, but also upon the distance or degree that a specific rib of the container 10 protrudes internally within or extends externally from the container 10 relative to the sidewall portion 24. Generally, the larger the compression rib 33, the greater the ability of the respective rib to absorb vacuum forces.

In some embodiments, additional reinforcing ribs 45 (see FIGS. 5C-5G) may be desired that extend along at least a portion of compression lands 43. In some embodiments, reinforcing ribs 45 can define an inwardly directed rib being sized to provide increased reinforcement of compression lands 43 to manage deflection and/or compression thereof and further focus compression within compression ribs 33. That is, reinforcing ribs 45 can be used to stiffen compression lands 43 during cooling and/or loading.

Compression ribs 33 are designed to achieve optimal performance with regard to vacuum absorption, top load strength and dent resistance by compressing slightly in a cross-sectional plane of the rib to accommodate for and absorb vacuum forces resulting from hot-filling, capping and cooling of the container contents.

The container 10 has been designed to retain a commodity, which may be in any form, such as a solid or liquid product. In one example, a liquid commodity may be introduced into the container 10 during a thermal process, typically a hot-fill process. For hot-fill bottling applications, bottlers generally fill the container 10 with a liquid or product at an elevated temperature between approximately 155° F. to 205° F. (approximately 68° C. to 96° C.) and seal the container 10 with a cap or closure before cooling. In addition, the container 10 may be suitable for other high-temperature pasteurization or retort filling processes or other thermal processes as well.

In another example, the commodity may be introduced into the container 10 under ambient temperatures. That is, in some applications, compression ribs 33 can provide similar performance when filled with liquids of other temperatures (i.e. ambient) and then exposed to a cooling environment (i.e. refrigerator). It should be appreciated that the present principles are equally applicable to such situations.

According to the principles of the present teachings, the container disclosed here provides a number of advantages over prior art designs, including focusing internal vacuum forces uniformly to the rigid and opposing sides of the container walls, causing the flexible compression ribs on the adjacent side walls to collapse inward to a lesser angle. This results in low residual vacuum inside the container after cooling, which decreases the risk of deformation, ovalization (unless desired), denting, and other defects associated with the internal vacuum forces generated by hot-filled beverages. Moreover, as the container side panels move inward due to the internal vacuum forces causing the vertical ribs to contract into a smaller diameter, the hoop strength and vertical stiffness of the container is increased. The result is an increase in top load strength that is a benefit for secondary packaging and palletizing. Still further, the decrease in residual vacuum combined with an increase in top-load strength may lead to a reduction in thermoplastic material thickness and weight, providing a lower cost container without sacrificing container performance. Using a combination of vertical and horizontal rib features can provide multiple ways to grip the container, making it more ergonomic for the consumer.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A one-piece plastic container for containing a liquid, said container comprising:

an upper portion;

a base portion closing off an end of the container;

a sidewall portion integrally formed with and extending from the upper portion to the base portion; and a plurality of compression ribs molded into said sidewall portion, a first of said plurality of compression ribs intersecting a second of said plurality of compression ribs to form a rib interface, at least said first and said second of said plurality of compression ribs each changing from a first shape to a second shape in response to cooling of the liquid, wherein said rib interface comprises a multi-surface collapsible joint.

2. The one-piece plastic container according to claim 1 wherein at least one of said plurality of compression ribs extends outwardly from the container.

3. The one-piece plastic container according to claim 1 wherein at least one of said plurality of compression ribs extends inwardly within the container.

4. The one-piece plastic container according to claim 1 wherein said first of said plurality of compression ribs is orthogonal to said second of said plurality of compression ribs.

5. The one-piece plastic container according to claim 1 wherein said rib interface comprises a plurality of inwardly-directed substantially flat surfaces that meet at a common apex.

6. The one-piece plastic container according to claim 1 wherein said first and said second of said plurality of compression ribs simultaneously change from said first shape to said second shape in response to cooling of the liquid.

7. The one-piece plastic container according to claim 1 wherein said first and said second of said plurality of compression ribs each changing from said first shape to said second shape in response to cooling of the liquid comprises said first and said second of said plurality of compression ribs each changing from a first angle to a second angle in response to cooling of the liquid, said second angle being less than said first angle.

8. The one-piece plastic container according to claim 1 wherein said first and said second of said plurality of compression ribs each changing from said first shape to said second shape in response to cooling of the liquid comprises said first and said second of said plurality of compression ribs each changing from a first arc to a second arc in response to cooling of the liquid, said second arc being less than said first arc.

9. The one-piece plastic container according to claim 1 wherein said first of said plurality of compression ribs comprises a first wall and a second wall joined along an inner wall, said first wall and said second wall pivoting relative to each other about said inner wall in response to said cooling of the liquid.

10. The one-piece plastic container according to claim 9 wherein said first wall is larger than said second wall at a given location.

11. The one-piece plastic container according to claim 1 wherein dimensions of at least one of said plurality of compression ribs vary along a length thereof.

12. A one-piece plastic container for containing a liquid, said container comprising:

an upper portion;

a base portion closing off an end of the container;

a sidewall portion integrally formed with and extending from the upper portion to the base portion; and a plurality of compression ribs molded into said sidewall portion, a first of said plurality of compression ribs intersecting a second of said plurality of compression ribs to form a rib interface, at least said first and said second of said plurality of compression ribs each changing from a first shape to a second shape in response to cooling of the liquid, wherein said rib interface comprises a plurality of interlocking surfaces.

* * * * *